US007490960B1

(12) United States Patent
Fiorino et al.

(10) Patent No.: US 7,490,960 B1
(45) Date of Patent: Feb. 17, 2009

(54) ADD-ON SENSOR MODULE FOR LIGHTING SYSTEM

(75) Inventors: Michael Fiorino, Billerica, MA (US); William Fabbri, Barnstead, NH (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 11/611,594

(22) Filed: Dec. 15, 2006

(51) Int. Cl.
*F21V 33/00* (2006.01)

(52) U.S. Cl. ..... 362/276; 362/364; 362/365; 362/802; 362/148

(58) Field of Classification Search ..... None
See application file for complete search history.

(56) References Cited

U.S. PATENT DOCUMENTS

| | | | | |
|---|---|---|---|---|
| 1,902,026 | A | 3/1933 | Hall | |
| 2,434,781 | A | 1/1948 | Kurtzon | |
| 2,455,333 | A | 11/1948 | Harris | |
| 2,539,974 | A | 1/1951 | Riddell | |
| 2,687,516 | A | 8/1954 | Schneiderman | |
| 2,958,763 | A | 11/1960 | Bodian | |
| 3,049,579 | A | 8/1962 | Sulzer | |
| 3,155,324 | A | 11/1964 | Chen | |
| 3,349,237 | A | 10/1967 | Jackson | |
| 3,555,267 | A | 1/1971 | Sutter | |
| 3,816,880 | A | 6/1974 | Jacobs | |
| 3,909,100 | A | 9/1975 | Hodge, Jr. | |
| 4,000,406 | A | 12/1976 | Bhavsar | |
| 4,054,790 | A | 10/1977 | Slaughter | |
| 4,298,918 | A | 11/1981 | Metcalf, II | |
| 4,323,953 | A | 4/1982 | Hutchison | |
| 4,407,011 | A | 9/1983 | Lahm | |
| 4,422,132 | A | 12/1983 | Trowbridge | |
| 4,494,175 | A | 1/1985 | Gawad et al. | |
| 4,498,126 | A | 2/1985 | Hernandez | |
| 4,646,212 | A | 2/1987 | Florence | |
| 5,008,790 | A | 4/1991 | Fabbri | |
| 5,177,404 | A * | 1/1993 | Cohen et al. | 315/154 |
| 5,183,327 | A | 2/1993 | Fabbri | |
| 5,371,444 | A | 12/1994 | Griffin | |
| 5,658,067 | A | 8/1997 | Engle et al. | |
| 6,164,797 | A | 12/2000 | Crane et al. | |
| 6,346,782 | B1 | 2/2002 | Knoble | |
| 6,422,721 | B1 | 7/2002 | Plunk et al. | |
| 6,582,106 | B2 * | 6/2003 | Jamison | 362/396 |
| 6,805,470 | B1 | 10/2004 | Ward | |
| 6,854,860 | B2 | 2/2005 | Plunk | |
| 6,948,831 | B1 * | 9/2005 | Naqvi | 362/276 |
| 7,175,315 | B2 * | 2/2007 | Eaton | 362/276 |
| 2003/0057889 | A1 * | 3/2003 | Avis | 315/291 |
| 2005/0201094 | A1 | 9/2005 | Plunk | |

* cited by examiner

*Primary Examiner*—Laura Tso
(74) *Attorney, Agent, or Firm*—John F. Salazar; Middleton Reutlinger

(57) ABSTRACT

A relocate able add-on control sensor module is described which electrically connects and controls at least one recessed light fixture. The relocate able add-on control module is mounted to a suspended ceiling t-bar grid and can be positioned anywhere in the ceiling grid while still controlling one or more recessed lighting fixtures. The control sensor module containing at least one sensor controlling light output of at least one recessed lighting fixture based on human occupancy, light intensity or both.

12 Claims, 4 Drawing Sheets

ADD-ON SENSOR MODULE FOR LIGHTING SYSTEM

BACKGROUND OF THE INVENTION

The present invention is related to a relocatable add-on sensor module for recessed lighting systems and in particular an add-on sensor module which senses motion, light intensity or other environment characteristics for control of recessed luminaires.

DETAILED DESCRIPTION OF THE INVENTION

Various types of lighting and luminaire controls are desirable as a means for controlling the amount of light as well as the amount of energy used by the lighting system during various installed environments. A number of various sensors and controlling electronics may be utilized such as motion sensors, light sensors, dimming electronic controls and other known electronic control devices, all of which may be integrated with lighting systems and luminaires. It is desirable to incorporate an add-on and relocatable sensor module allowing for the mounting of a variety of available sensors for control of recessed luminaires. Module sensors are selectable to respond to multiple environmental circumstances in order to reduce the amount of light produced by the luminaire, control or reduce the amount of electricity utilized by the luminaire, or activate/deactivate the luminaire or lighting system. By relocatable, it is meant that the add-on sensor module is constructed so as to be movable, portable, prefabricated, or modular, as well as separate and distinct from the actual controlled recessed luminaire. Such add-on sensor modules are highly desirable and should necessarily be easy to install and incorporate with existing luminaire and ceiling constructions, both from the standpoint of wiring as well as interfacing with the ceiling and the luminaire control circuitry. Many characteristics may also be required and implemented herein, such as modularity, simple construction, easy installation and integration with a ceiling support and grid system, clamping mechanisms for integrating into said system, as well as electronic controls contained within the module for electrically connecting and controlling the external recessed luminaire (s).

Figure 1:
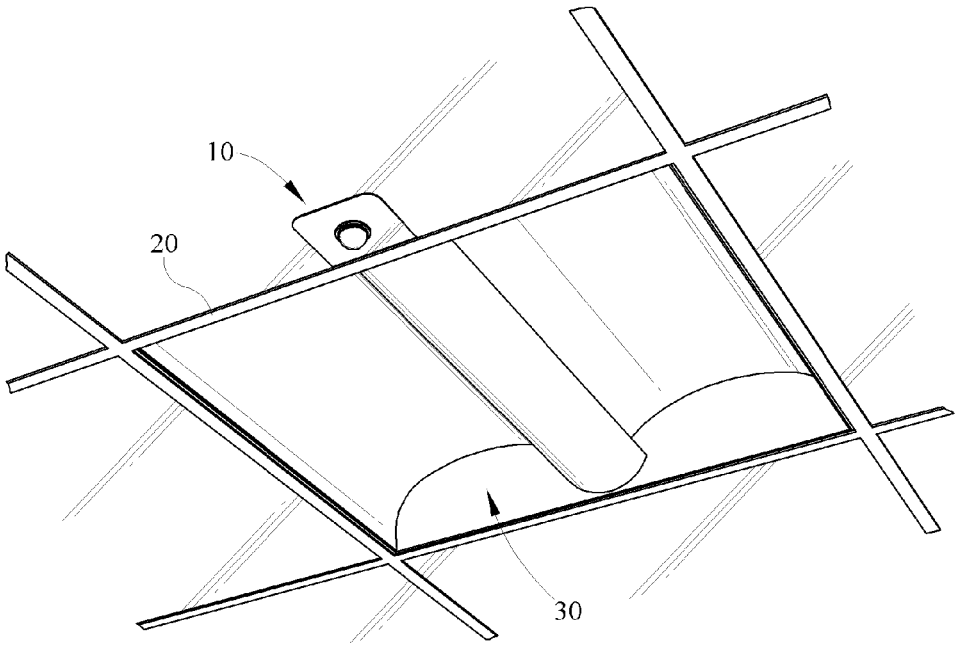
FIG. 1 is a lower view of the add-on sensor module for recessed lighting systems of the present invention as installed in the suspended ceiling and t-bar grid system.
Figure 2:
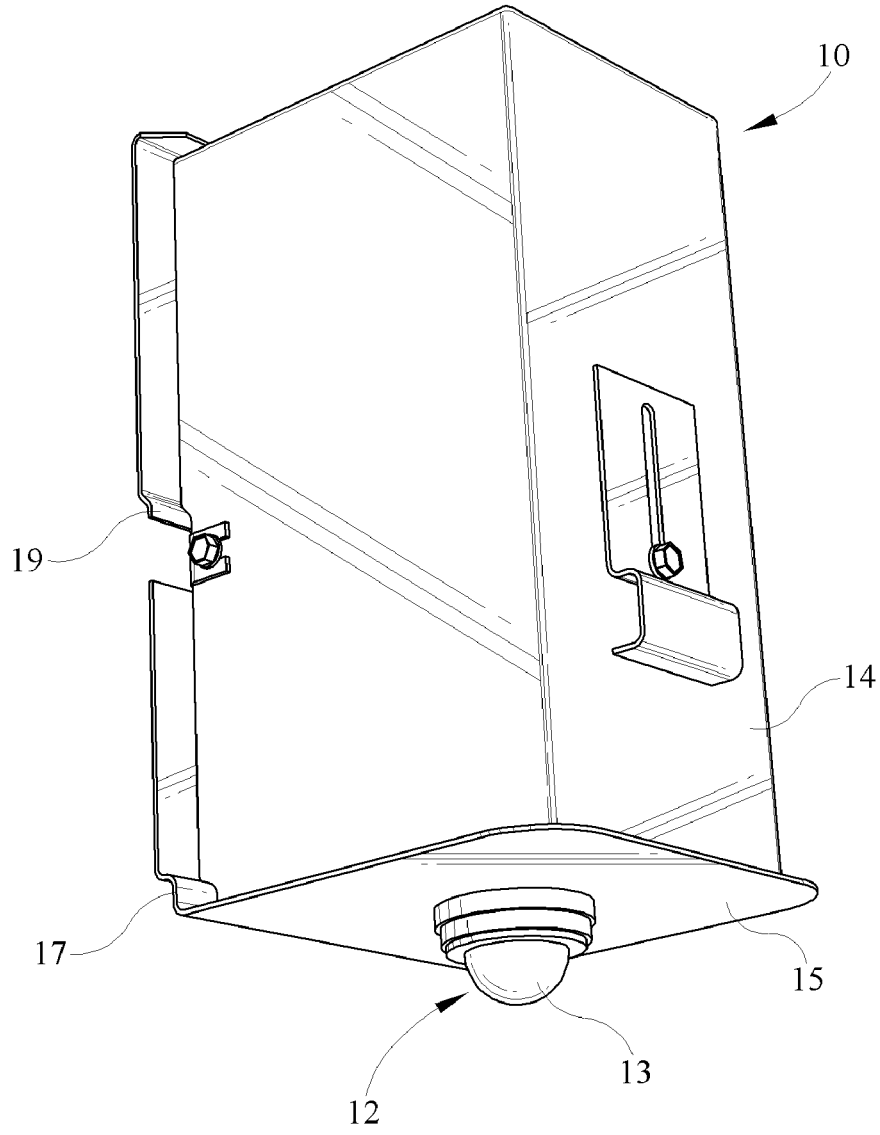
FIG. 2 is a perspective view of the add-on sensor module for recessed lighting systems of the present invention.
Figure 3:
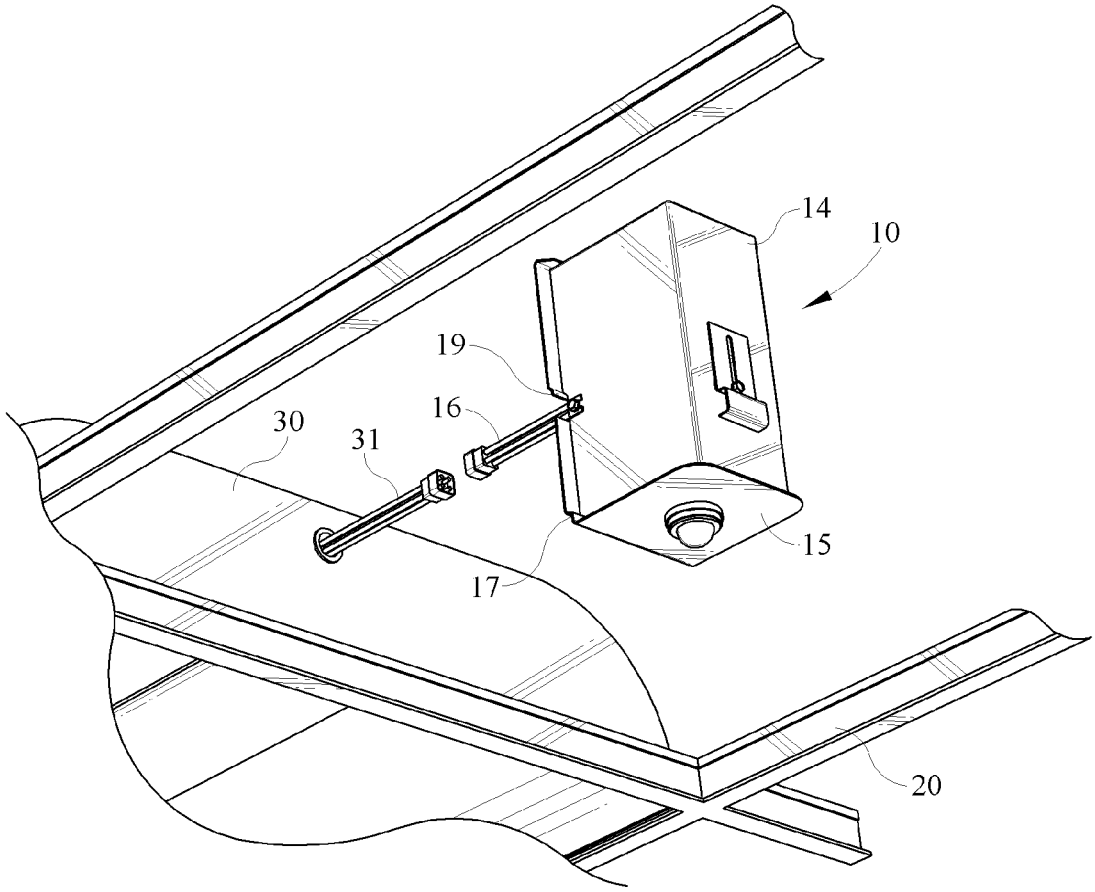
FIG. 3 is an exposed view of the add-on sensor module for recessed lighting systems of the present invention in conjunction with at least one recessed luminaire and a t-bar suspended ceiling grid system.

As disclosed in FIGS. 1 and 2, an add-on sensor module 10 of the present invention is depicted as disclosed and is electronically configured to control a recessed luminaire 30 in a t-bar grid system 20 as is shown. The add-on sensor module 10 is a separate control system for controlling a multitude of luminaires and recessed lighting systems. The add on sensor module 10 may be integrated with pre-existing or pre-installed recessed luminaires or may be installed initially in order to control one or more recessed luminaires 30. The add-on sensor module 10 of the present invention, as is depicted and disclosed herein, may generally incorporate control of a plurality of luminaires as required such that entire banks of luminaires may be effected by the add-on sensor control module 10 in order to effect the desired characteristic and measured environmental condition. The add-on sensor control module 10 can contain any variety of sensors to control the light output of the recessed luminaire 30 including, but not limiting to, motion sensing, light intensity sensing or other environmental characteristics as measured by the sensor 12. The add-on sensor module 10 for the recessed luminaire of the present invention may be a stand-alone, modular, add-on product which is designed to interface with a variety of recessed luminaires and which has control cables which directly interface with the lighting control cables 31, as depicted in FIG. 3, of the target recessed luminaire. It is further desirable that the sensor module 10 of the present invention provide a housing 14 which has a trim flange 15 which allows the add-on sensor module 10 be mounted directly to a ceiling member, such as a t-bar support system 20 as shown, and positioned adjacent or near to the controlled luminaire 30, the trim flange 15 provided to cleanly finish the opening formed in the ceiling. The add-on sensor module 10 of the present invention is not desired to be mounted directly to a ceiling tile but may be separately added on as an independent unit and attached directly to the t-bar support grid 20 as is depicted. The trim flange 15, which is shown in FIGS. 2 and 3, incorporates a face plate on which the sensor 12 is mounted and on which the diameter of the sensor 12 mounting, as well as the lens 13, may be modified in order to accept a wide variety of types of sensors. The trim flange 15 is designed such that it may finish off the opening formed in a ceiling tile where it penetrates through the tile in order to provide a clean installed appearance as depicted. Multiple mechanisms are provided on the housing in order to properly install the add-on sensor module 10 of the present invention onto the t-bar grid support system 20.

As is commonly understood and known in the art, t-bar support grids 20 as depicted, are utilized to support ceiling tiles and other luminaires and recessed luminaire systems 30 as are shown. These common place t-bar support grids 20 typically provide openings of various desired widths and are utilized to support air vents, luminaires, and other systems. As is depicted herein, for installation of the add-on sensor module 10 for a recessed lighting system 30 of the present invention, the add-on sensor module 10 of the present invention may be incorporated in a pre-existing t-bar grid support system and placed in electrical connectivity and control of a recessed luminaire 30, in this example a fluorescent troffer luminaire supported in the ceiling. As shown in FIG. 3, wherein the ceiling tiles are shown as being removed, the add-on sensor module 10 may be electrically connected to the recessed luminaire 30. An aperture or various other hole, as shown in FIG. 1, may be formed in the ceiling tile for exposing the sensor module 10 and sensor 12 there through, leaving the trim flange 15 exposed on a lower surface of the ceiling tile in order to properly finish and provide a clean appearance to the exposed ceiling tile. Meanwhile, the entire add-on sensor module 10 may be directly affixed to the t-bar support grid 20 either directly adjacent to the recessed luminaire 30 or placed in remote proximity thereto.

The housing 14 of the add-on sensor module 10 of the present invention may incorporate both a mounting lip 17 for flush connectivity to the lower portion of the t-bar grid system as shown, in combination with a t-bar support 19 which may have a clamping mechanism adjacently positioned thereby in order to properly allow the modular sensor module 10 of the present invention to be directly affixed to the t-bar support grid 20. As shown in FIG. 2, the t-bar support 19 attached to the housing 14 provides a longitudinally extending lip 19 which can clasp or clamp onto the top edge of the t-bar support grid 20 as shown installed on FIG. 4. Thus, the add-on sensor module 10 may be directly affixed to the t-bar support grid 20 in multiple configurations which provides increased flexibility for installation and positioning of the sensor module 10 depicted herein. Various known clamping and removable support assemblies may be integrated within the housing 14 of the sensor module 10 of the present invention and the t-bar support 19 attached to a single side of the sensor module 10 is but one of a number of implementations which may be utilized. It may be desirable such that the add-on sensor module 10 of the present invention may be readily and easily removable and attachable to the t-bar support grid 20 such that placement may be modified or installed in multiple positions. Further, the clamping mechanism may allow for floating connectivity such that the height of the module may vertically be adjusted depending on the ceiling depth, position of the grid, and other factors.

Integrated with the add-on sensor module 10 of the present invention may be a sensor control line 16 which may be provided with a number of attachments for electrical control and connectivity to the recessed luminaire 30. As is shown in FIG. 3, the removable and pluggable connections may be utilized in order to electrically and controllingly connect the add-on sensor module 10 to the recessed luminaire 30 such that the connectors may exit either the housing 14 or the luminaire housing for the recessed luminaire 30 and exit thereby without having to entirely open the module itself. The sensor control line 16 may be readily configurable to any desirable configuration to connect to a recessed luminaire control line 31 as is shown as long as the add-on sensor module 10 of the present invention is placed in electrical and control connectivity with the luminaire 30. Various known sensor control lines and connectors are available for use and integration with the add-on sensor module 10 depicted.

Figure 4:
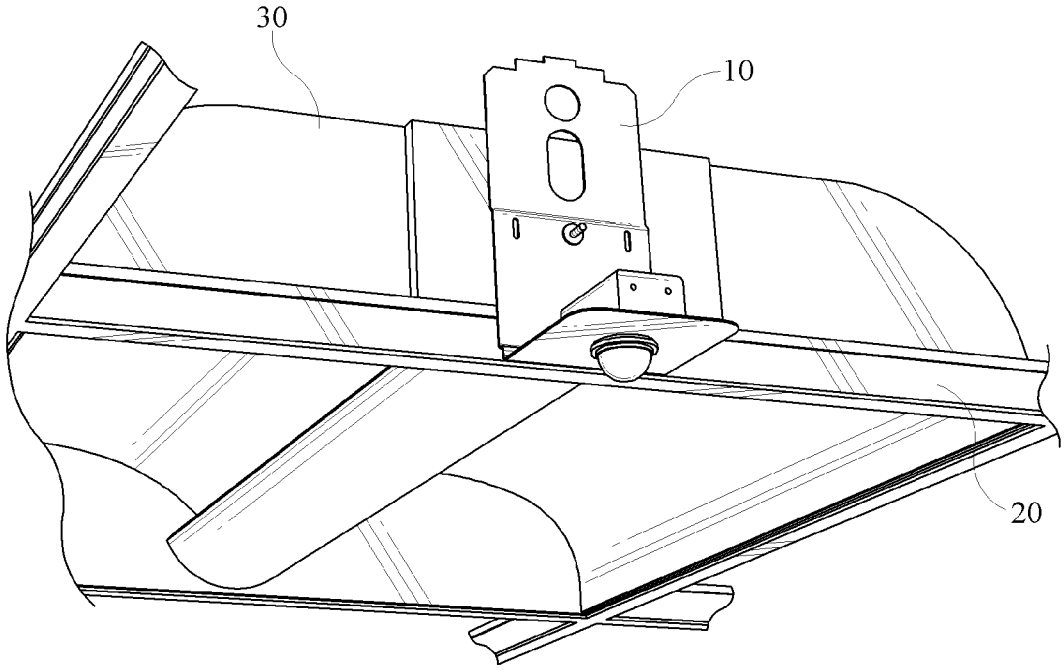
FIG. 4 is a side-view of the add-on sensor module for recessed lighting systems of the present invention as installed with a portion of the housing and inner connection wiring removed for clarity.

The add-on sensor module 10 of the present invention, as shown in FIG. 2 and FIG. 4, incorporates a sensor 12 extending below the trim flange 15 such that varying environmental characteristics may be measured by control electronics placed on an interior portion of the housing 14. The exposed sensor 12 may be covered by a lens 13 as is necessary, the lens 13 either controlling the input characteristics of the environmental condition being measured or magnifying the same characteristics. The sensor 12 affixed to the add-on sensor module 10 of the present invention may measure a number of different known characteristics and control circuitry and electronics may be placed on an interior of the housing 14 for proper electronic control of the recessed luminaire 30. Such control electronics are well known in the art and may be integrated with the sensor module 12 and with the sensor control line 16 as is necessary to control the light output of the recessed luminaire 30 depicted. The housing 14, as previously described, incorporates the clamp mechanism in order to directly and removable attach the add-on sensor module 10 of the present invention to the adjacent t-bar support grid 20 for mounting. The sensor control line 16 may be directly connected to the recessed luminaire control line 31 in order that the add-on sensor module of the present invention may directly and electronically control the recessed luminaire 30 shown. The sensor module control line 16 as well as the troffer or recessed luminaire control line 31 may be resident in the interior of the housing, the respective devices may be pulled out through openings without the necessity of opening either housing such that they may be placed in electronic connectivity. The ceiling tile at which the add-on sensor module 10 of the present invention is to be incorporated may then be notched and installed on top of the trim flange 15 after clamping of the t-bar support 19 directly to the t-bar support grid 20 and further by providing additional clamp 22 to position the ceiling tile tightly to said trim flange 15 to eliminate unsightly gaps as seen from below the ceiling and provide vertical adjustability thereof.

The add-on sensor control module 10 of the present invention provides a system for adding control of at least one recessed luminaire, which incorporates a housing and a mechanism for mounting the add-on control sensor module 10 to a suspended ceiling member next to a recessed luminaire 30. The add-on sensor module of the present invention may contain at least one sensor 12 for controlling light output of at least one luminaire 30 wherein the add-on sensor module 10 may be installed and at least one ceiling tile may be modified in order to provide an opening for the sensor module to penetrate the ceiling tile. The add-on sensor module 10 incorporates a trim flange 15 in order to hide the edges of the ceiling tile which are cut for the opening thereof. The add-on sensor module 10 of the present invention provides a means for electronically controlling and being placed into electrical connectivity between the add-on sensor module 10 and the recessed luminaire 30.

A number of configurations are available for the add-on sensor module 10 of the present invention as is discussed and disclosed herein. While the add-on sensor module 10 has been described for a number of embodiments, the invention presented is not limited to the specific structure and elements taught. The disclosure and claims are intended to cover various modifications and equivalent arrangements included herein and are considered to be incorporated within the spirit and scope of the teachings hereof. The scope the claims set forth are to be accorded the broadest interpretation so as to encompass all such modifications and equivalent structures and functionality.

The invention claimed is:

1. A relocatable, add-on control sensor module for control of at least one recessed light fixture mounted in a suspended ceiling system comprising:

a sensor module including a sensor module housing having a bottom trim flange and at least one sensor extending through said trim flange;

at least one recessed light fixture to which said add-on sensor module is electrically connected by a sensor control line allowing direct communication between said light fixture and said sensor module;

a suspended ceiling t-bar grid support member extending along at least one side of said sensor module housing to which said sensor module housing is mounted;

a bracket affixed to said sensor module housing for mounting said module to said support member separate and remote from said recessed light fixture;

wherein said sensor module housing is separate and relocatable from said light fixture such that said sensor module housing is relocatable to a point remote from said recessed light fixture and designed for affixation directly to said suspended ceiling t-bar grid support member.

2. The relocatable add-on sensor module for use with a recessed light fixture of claim 1 wherein said sensor is a light intensity sensor.

3. The relocatable add-on sensor module for use with a recessed light fixture of claim 1 wherein said sensor is an occupancy sensor.

4. The relocatable add-on sensor module for use with a recessed light fixture of claim 1 wherein said sensor control line has a pluggable connector at one end.

5. The relocatable add-on sensor module for a recessed fluorescent light fixture of claim 1 wherein said bracket for mounting to said t-bar ceiling grid support member is a clamp.

6. A system for controlling at least one recessed light fixture with at least one add-on sensor module, comprising:

at least one recessed light fixture supported on a suspended t-bar grid ceiling system;

at least one add-on sensor control module designed for separate mounting to said t-bar grid ceiling, said sensor module in electrical connectivity with said at least one said recessed lighting fixture;

said sensor control module having at least one t-bar mount on at least one external surface;

said module having a trim flange to cover an exposed opening cut in a ceiling tile supported by said t-bar grid ceiling and at least one control sensor exposed through said trim flange and in controlling electrical connectivity by a sensor control line with said recessed light fixture such that said sensor module is relocatable to a point remote from said recessed light fixture and designed for affixation directly to a suspended ceiling t-bar grid support member.

7. The add-on sensor module of claim 6 wherein said mount further comprises a clamp to position a ceiling tile tightly to said trim flange to eliminate unsightly gaps as seen from below the ceiling.

8. The add on sensor module of claim 7 wherein said clamp has vertical adjustability for a range of ceiling tile thicknesses.

9. The add on sensor module of claim 1 wherein said sensor module housing is suitable for use as a splice box for electrical connections.

10. A repositionable add-on sensor module for a recessed fluorescent light fixture comprising:

a sensor module housing having a bottom trim flange and a sensor extending through said trim flange;

a sensor control line extending from said sensor module housing for electrical connection and control of said recessed fluorescent light fixture;

a t-bar grid support member extending along at least one side of said sensor module housing;

wherein said sensor module has control electronics for controlling the light output of said recessed fluorescent light fixture, said control electronics in electrical connectivity with said sensor and said recessed fluorescent light fixture such that said sensor module is relocatable to a point remote from said recessed light fixture and designed for affixation directly to a suspended ceiling t-bar grid support member.

11. The add-on sensor module of claim 10 wherein said sensor module is electrically connected to a plurality of recessed fluorescent fixtures.

12. A relocatable modular sensor module for controlling at least one recessed fluorescent light fixture, comprising:

a sensor module having an exposed trim flange for finishing off an exposed aperture in a ceiling, said exposed trim flange having an outwardly extending lens, said lens covering a sensor, said sensor electrically connected to control electronics in said sensor module;

a t-bar grid support mechanism for releasably attaching said modular sensor module to a t-bar grid member, said support mechanism allowing said modular sensor module to be vertically and horizontally adjusted separate from said fixture;

a luminaire control line extending form said modular sensor module to electrically connect to a recessed luminaire, said sensor module controlling said luminaire based upon input from said sensor and independently locatable separate from said luminaire.

* * * * *